US007970330B2

(12) United States Patent
Condello et al.

(10) Patent No.: US 7,970,330 B2
(45) Date of Patent: Jun. 28, 2011

(54) FUSERS, PRINTING APPARATUSES AND METHODS OF FUSING TONER ON MEDIA

(75) Inventors: Anthony S. Condello, Webster, NY (US); Augusto E. Barton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 259 days.

(21) Appl. No.: 12/261,680

(22) Filed: Oct. 30, 2008

(65) Prior Publication Data

US 2010/0111579 A1 May 6, 2010

(51) Int. Cl.
*G03G 15/20* (2006.01)

(52) U.S. Cl. ..... 399/329; 399/323

(58) Field of Classification Search ..... 399/329, 399/328, 323, 320; 219/216, 469–471
See application file for complete search history.

(56) References Cited

U.S. PATENT DOCUMENTS

| | | | | |
|---|---|---|---|---|
| 5,035,829 | A * | 7/1991 | Suwala | |
| 5,124,755 | A * | 6/1992 | Hediger | 399/329 |
| 5,998,761 | A * | 12/1999 | Berkes et al. | 219/216 |
| 6,687,468 | B2 * | 2/2004 | Holubek et al. | 219/216 |
| 6,819,890 | B1 * | 11/2004 | Bott et al. | |
| 7,477,858 | B2 * | 1/2009 | Fujii et al. | 399/329 |
| 7,653,321 | B2 * | 1/2010 | Yoshikawa | 399/329 |
| 7,668,494 | B2 * | 2/2010 | Kubo et al. | 399/328 |
| 2002/0051650 | A1 * | 5/2002 | Ando et al. | 399/328 |
| 2004/0105691 | A1 * | 6/2004 | Hama et al. | |
| 2004/0251435 | A1 * | 12/2004 | Sawayama et al. | |
| 2006/0210331 | A1 | 9/2006 | Baba et al. | |
| 2007/0048035 | A1 | 3/2007 | Baba et al. | |
| 2007/0048042 | A1 | 3/2007 | Uehara et al. | |
| 2007/0092277 | A1 | 4/2007 | Miyata et al. | |
| 2007/0166084 | A1 | 7/2007 | Yoshino et al. | |
| 2007/0172272 | A1 * | 7/2007 | Miyata et al. | 399/329 |
| 2007/0212085 | A1 * | 9/2007 | Mitsuya et al. | 399/328 |
| 2008/0037069 | A1 | 2/2008 | Mestha et al. | |
| 2008/0056783 | A1 * | 3/2008 | Yamamoto et al. | 399/329 |

FOREIGN PATENT DOCUMENTS

| | | | |
|---|---|---|---|
| JP | 2003112840 A | * | 4/2003 |
| JP | 2006069737 A | * | 3/2006 |
| JP | 2006208785 A | * | 8/2006 |
| JP | 2008170585 A | * | 7/2008 |

* cited by examiner

*Primary Examiner* — Susan S Lee
(74) *Attorney, Agent, or Firm* — Ronals E. Prass, Jr.; Prass LLP

(57) ABSTRACT

Fusers, printing apparatuses and methods of fusing toner on media are disclosed. An exemplary embodiment of the fusers includes a pressure roll; a fuser belt; a nip formed by the fuser belt contacting the pressure roll, the nip including an inlet end where the medium enters the nip, an outlet end where the medium exits the nip, and a nip width defined between the inlet end and the outlet end; a mechanism for moving the pressure roll toward or away from the fuser belt to adjust the nip width; and a stripping member for stripping the medium from the fuser belt after the medium exits from the outlet end of the nip.

15 Claims, 6 Drawing Sheets

FUSERS, PRINTING APPARATUSES AND METHODS OF FUSING TONER ON MEDIA

BACKGROUND

In some printing apparatuses, toner images are formed on media and the media are then heated to fuse (fix) the toner onto the media. Such printing apparatuses can include a fuser member and a pressure roll, which define a nip between them. Media are fed to the nip where the fuser member and pressure roll heat and apply pressure to the media to fuser the toner.

It would be desirable to provide apparatuses and methods for fusing toner on different types of media efficiently.

SUMMARY

Fusers, printing apparatuses and methods of fusing toner on media are disclosed. An exemplary embodiment of the fusers comprises a pressure roll; a fuser belt; a nip formed by the fuser belt contacting the pressure roll, the nip including an inlet end where the medium enters the nip, an outlet end where the medium exits the nip, and a nip width defined between the inlet end and the outlet end; a mechanism for moving the pressure roll toward or away from the fuser belt to adjust the nip width; and a stripping member for stripping the medium from the fuser belt after the medium exits from the outlet end of the nip.

DRAWINGS

DETAILED DESCRIPTION

The disclosed embodiments include a fuser for fusing toner on a medium, which comprises a pressure roll; a fuser belt; a nip formed by the fuser belt contacting the pressure roll, the nip including an inlet end where the medium enters the nip, an outlet end where the medium exits the nip, and a nip width defined between the inlet end and the outlet end; a mechanism for moving the pressure roll toward or away from the fuser belt to adjust the nip width; and a stripping member for stripping the medium from the fuser belt after the medium exits from the outlet end of the nip.

The disclosed embodiments further include a fuser for fusing toner on a medium, which comprises a fuser roll; a pressure roll including an outer layer comprised of an elastomeric material; a fuser belt supported on the fuser roll and including an outer layer comprised of an elastomeric material; a nip formed by the outer layer of the fuser belt contacting the outer layer of the pressure roll, the nip including an inlet end where the medium enters the nip, an outlet end where the medium exits the nip, and a nip width defined between the inlet end and the outlet end; a mechanism for moving the pressure roll toward or away from the fuser belt to vary the magnitude of a load applied by the pressure roll to the fuser belt to adjust the nip width; and a stripping member located between the fuser roll and fuser belt for stripping the medium from the fuser belt after the medium exits from the outlet end of the nip. The medium is stripped from the fuser belt substantially without creep of the fuser belt.

The disclosed embodiments further include a method of fusing toner on a medium in a fuser comprising a fuser roll, a pressure roll and a fuser belt located between the fuser roll and the pressure roll. The method comprises moving the pressure roll toward or away from the fuser belt to adjust the width of a nip formed by the fuser belt contacting the pressure roll to a first nip width defined between an inlet end and an outlet end of the nip; feeding a first medium carrying first toner to the inlet end of the nip; heating and applying pressure to the first medium at the nip to fuse the first toner onto the first medium; and stripping the first medium from the fuser belt after the first medium exits from the outlet end of the nip.

Figure 1:
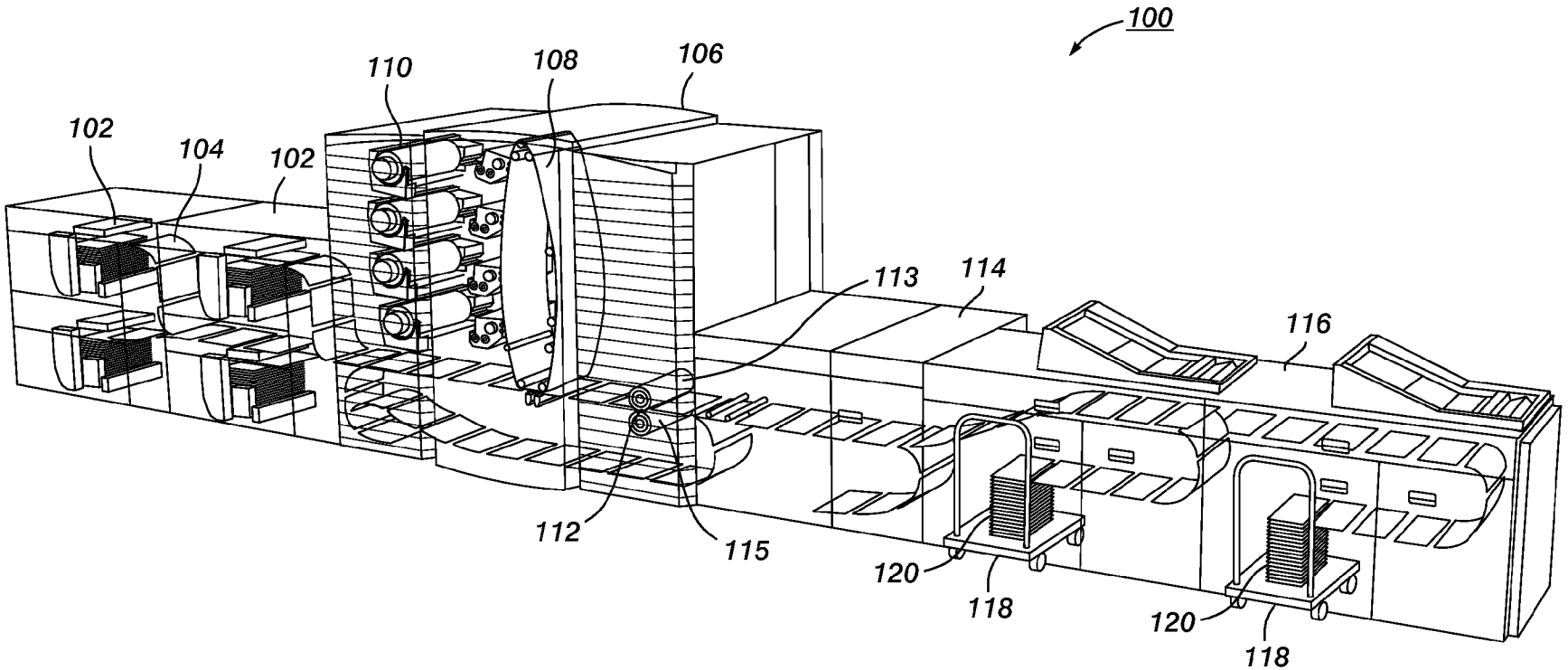
FIG. 1 illustrates an exemplary embodiment of a printing apparatus.

FIG. 1 illustrates an exemplary printing apparatus 100, such as the apparatuses disclosed in U.S. Patent Application Publication No. 2008/0037069, which is incorporated herein by reference in its entirety. As used herein, the term "printing apparatus" encompasses any apparatus, such as a digital copier, bookmaking machine, multifunction machine, and the like, that performs a print outputting function for any purpose. The printing apparatus 100 can be used to produce prints at high speeds using media with various sizes and weights. In embodiments, the printing apparatus 100 has a modular construction. As shown, the apparatus includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 feed media to the printer module 106. In the printer module 106, toner is transferred from a series of developer stations 110 to a charged photoreceptor belt 108 to form toner images on the photoreceptor belt and produce color prints. The toner images are transferred to one side of respective media 104 fed through the paper path. The media are advanced through a fuser 112 including a fuser roll 113 and pressure roll 115, which apply heat and pressure to the media to fuse toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

In the illustrated printing apparatus 100, the fuser roll 113 and pressure roll 115 define a nip at which these rolls heat and apply pressure to media. The nip has a width in the process direction (i.e., the direction along which media are transported through the nip). The nip width is the distance between the nip entrance and the nip exit in the process direction, and can be expressed as the product of dwell and process speed (i.e., nip width=dwell×process speed). The nip width can be increased by increasing the pressure applied between the fuser roll 113 and pressure roll 115.

In fusers including a pressure roll and a fuser roll for contact fusing of toner on media, nip widths are typically set during installation or maintenance. The nip width can change due to material wear and/or other tolerances. However, the nip width is not actively adjusted during printing operations in such fusers.

In the fuser 112, the fuser roll 113 can include an outer layer made of an elastomeric material having an outer surface region that experiences strain when the fuser roll 113 and pressure roll 115 apply forces against each other. This strain that occurs in the surface region of the fuser roll 113, expressed as a percentage, is referred to herein as "creep." The magnitude of the creep of the outer surface region is directly related to the nip width. That is, as the nip width increases, creep also increases. In the fuser 112, such creep of the outer layer of the fuser roll 113 is used to strip media from the fuser roll 113 after the media have passed through the nip. The lowest amount of fusing (i.e., smallest nip width) and the highest amount of creep are desirable for stripping light-weight media, which are less rigid. Conversely, a higher nip width and lower creep (with lower edge wear) are desirable for stripping heavy-weight media, which are more rigid, in such fusers.

Other fuser configurations can include a pressure roll and a thick fuser belt for fusing toner on media. A thick fuser belt typically has a thickness of about 1 mm to about 5 mm. In such fusers, creep occurs in one or more outer-most layers of these fuser belts. This creep is utilized for stripping media and toner from the thick fuser belts.

Figure 2:
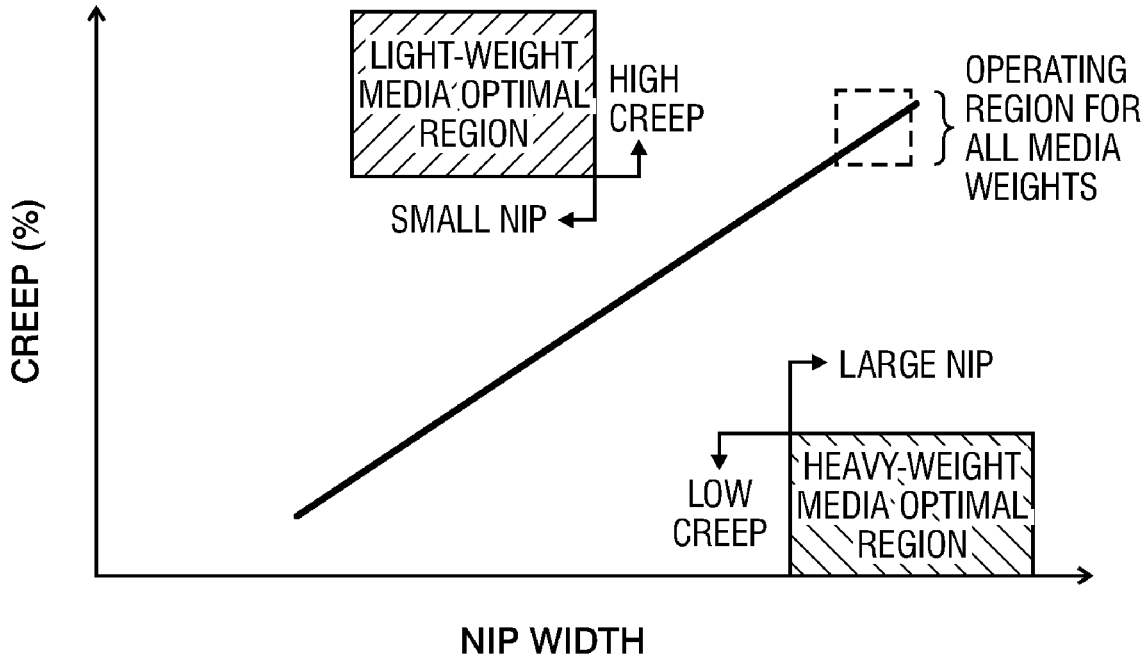
FIG. 2 illustrates the relationship between creep of a fuser member and nip width in a printing apparatus.

FIG. 2 graphically demonstrates difficulties associated with simultaneously optimizing both fusing and stripping functions for all media weights in a fuser including a roll pair (pressure roll and fuser roll) used to fuse toner on media. FIG. 2 shows an example of the linear relationship existing between creep and nip width for a fuser including a roll pair (pressure roll and fuser roll) for fusing toner on media. FIG. 2 also shows the respective optimal regions (i.e., creep and nip width conditions) for light-weight media and heavy-weight media, and an operating region that may instead be used for all media weights in such fusers. As shown, the operating region used in the fuser for different types of media meets the desired minimum level of creep for stripping light-weight media, as well as the minimum nip width for fusing heavy-weight media. However, by operating the fuser in the operating region for all media weights instead of in the different optimal regions for different media types, light-weight can be over-fused, and heavy-weight media can generate excessive edge-wear.

The difficulties associated with optimizing both fusing and stripping functions for all media weights as demonstrated in FIG. 2 are also encountered in fusers including a pressure roll and a thick fuser belt.

Figure 3:
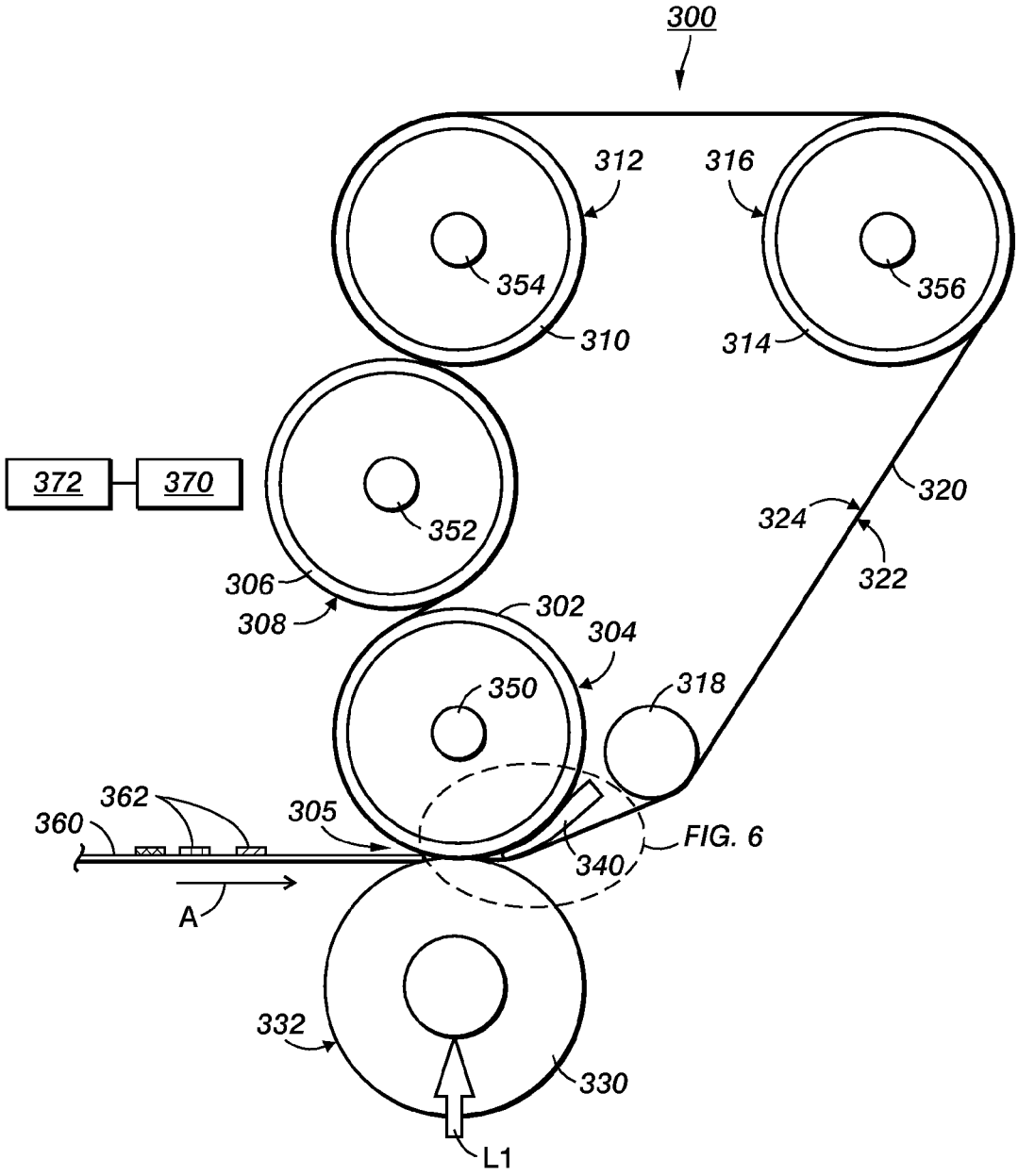
FIG. 3 illustrates an exemplary embodiment of a fuser including a fuser belt.

FIG. 3 illustrates a fuser 300 according to an exemplary embodiment. The fuser 300 is constructed to facilitate decoupling of the fusing and stripping functions for all media weights used in the fuser. Embodiments of the fuser 300 can be used in different types of printing apparatuses. For example, the fuser 300 can be used in the printing apparatus 100 shown in FIG. 1, in place of the fuser 112.

Embodiments of the fusers include a fuser belt supported by at least two rolls. At least one of the rolls is internally heated. As shown in FIG. 3, the fuser 300 includes an endless (continuous) fuser belt 320 supported by a fuser roll 302 and a plurality of idler rolls 306, 310, 314 and 318. The fuser belt 320 has an outer surface 322 and an opposite inner surface 324. In embodiments, the idler rolls 306, 310, 314 can have about the same outer diameter as each other, and the idler roll 318 a smaller outer diameter. In other embodiments, the fuser 300 can include less than four (e.g., one), or more than four, idler rolls supporting the fuser belt 320. At least one idler roll can be internally heated.

The fuser roll 302 and idler rolls 306, 310, 314 include respective outer surfaces 304, 308, 312, 316 contacting the inner surface 324 of the fuser belt 320, and respective internal heating elements 350, 352, 354 and 356. The heating elements 350, 352, 354 and 356 can be, e.g., axially-extending lamps connected to a power supply 370. In embodiments, more than one heating element can be included in each heated fuser roll and/or idler roll. In embodiments, the power supply 370 is connected to a controller 372. The controller 372 can control the power supply 370 to control the operation of the heating elements 350, 352, 354 and 356 in order to control heating of the fuser belt 320 to the desired temperature for fusing toner on different types of media.

The fuser 300 further includes a pressure roll 330 having an outer surface 332. The pressure roll 330 and fuser belt 320 define a nip 305 between the outer surface 322 and the outer surface 332. In embodiments, the pressure roll 330 can include a core and an outer layer including the outer surface 332 over the core. In embodiments, the core can be comprised of aluminum or the like, and the outer layer of an elastically deformable material, such as perfluoroalkoxy (PFA) copolymer resin, or the like.

Embodiments of the fuser belt 320 can have a multi-layer construction including, e.g., a base layer, an intermediate layer on the base layer, and an outer layer on the intermediate layer. In such embodiments, the base layer forms the inner surface 324 of the fuser belt 320 contacting the fuser roll 302 and idler rolls 306, 310, 314 and 318 supporting the fuser belt 320. The outer layer forms the outer surface 322 of the fuser belt 320. In an exemplary embodiment of the fuser belt 320, the base layer is composed of a polymeric material, such as polyimide, or the like; the intermediate layer is composed of silicone, or the like; and the outer layer is composed of a polymeric material, such as a fluoroelastomer sold under the trademark Viton® by DuPont Performance Elastomers, L.L.C., polytetrafluoroethylene (Teflon®), or the like.

In embodiments, the fuser belt 320 is a thin belt having a thickness of about 0.1 mm to about 0.6 mm. For example, the base layer can have a thickness of about 50 μm to about 100 μm, the intermediate layer a thickness of about 150 μm to about 200 μm, and the outer layer a thickness of about 20 μm to about 40 μm. The fuser belt 320 can typically have a width of about 350 mm to about 450 mm. Embodiments of the fuser belt 320 can have a length of at least about 500 mm, about 600 mm, about 700 mm, about 800 mm, about 900 mm, about 1000 mm, or even longer. Such longer fuser belts provide a larger surface area for wear than shorter belts.

FIG. 3 depicts a medium 360 carrying toner images 362 being fed to the nip 305 in the process direction A. In embodiments, the fuser roll 302 is rotated counter-clockwise by a drive mechanism, and the pressure roll 320 is rotated clockwise, to convey the medium 360 through the nip 305. The medium 360 can be a light-weight type, e.g., light-weight paper, and/or the toner images 362 can have low toner mass. Typically, paper can be classified by weight as follows: light-weight: ≦about 75 gsm, medium-weight: about 75 gsm to about 160 gsm, and heavy-weight: ≧160 gsm. A low toner mass is typically less than about 0.8 mg/cm$^2$. A larger amount of energy (both per thickness and per basis weight) is applied to fuse toner on coated media as compared to uncoated media. In embodiments, the outer surface 332 of the pressure roll 330 is deformed when brought into contact with the fuser belt 320. The outer surface 304 of fuser roll 302 can also be deformed by this contact depending on the material forming the outer region including outer surface 304. For example, when the region including outer surface 304 is comprised of an elastomeric material, the outer surface 304 is also deformed by this contact. In embodiments, the nip width can typically be about 5 mm to about 20 mm. FIG. 3 illustrates a small nip width formed between the fuser belt 320 and pressure roll 330. For example, the small nip width can be about 14 mm to about 18 mm when the fuser roll 302 and pressure roll 330 have a diameter of about four inches. The size range of a small nip width can vary with the diameter of the fuser roll 302 and pressure roll 320, and/or the process speed used in the fuser 300.

In the fuser 300, the nip width of nip 305 is determined by the magnitude of the load, $L_1$, applied via the outer surface 332 of the pressure roll 320 to the fuser belt 320 and the outer surface 304 of the fuser roll 302, as well as by the deformability (softness) of the outer surface 332 (and also the outer surface 304 of fuser roll 302 when comprised of a deformable material) resulting from applying the load $L_1$.

Figure 4:
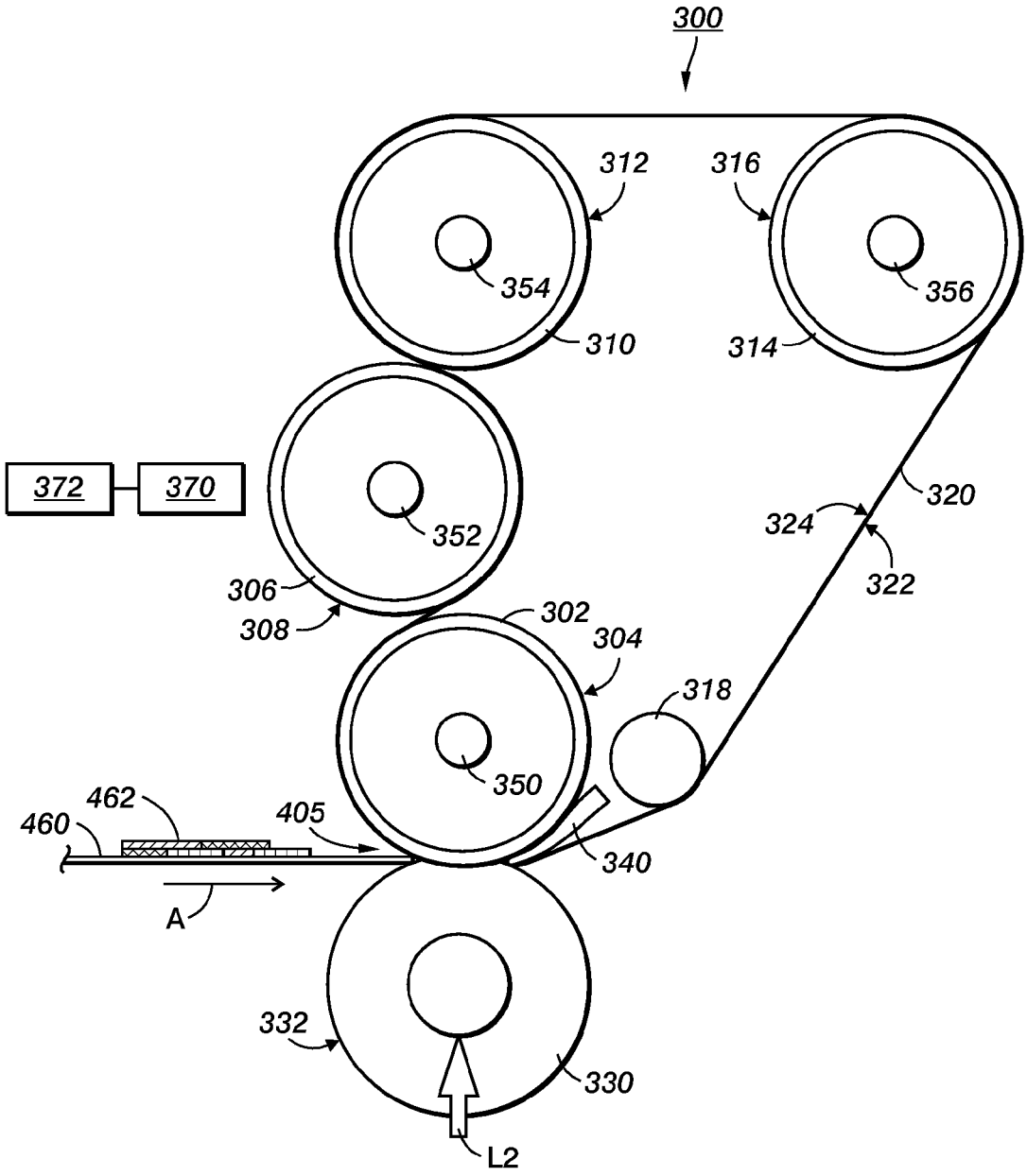
FIG. 4 illustrates the fuser of FIG. 3 with an increased nip width.

FIG. 4 depicts the nip 305 of the fuser 300 with a large nip width formed between the outer surface 332 of pressure roll 330 and the fuser belt 320 when a medium 460 carrying toner images 462 is fed to the nip 305 in the process direction A. The medium 460 can be a heavy-weight type, e.g., heavy-weight paper or a transparency, and/or the toner images 462 can have a high toner mass. The large nip width can be, e.g., about 18 mm to about 22 mm when the fuser roll 302 and pressure roll 320 have a diameter of about four inches. A high toner mass on a medium is typically at least about 0.8 $mg/cm^2$. The large width of nip 305 shown in FIG. 4 is produced by increasing the magnitude of the applied load from $L_1$ to $L_2$ to increase the amount of deformation of the outer surface 332 of pressure roll 330, which causes an increase in the width of the contact region formed between the outer surface 332 and the fuser belt 320 in the process direction A, and an increase in the length of the portion of the fuser belt 320 in contact with the fuser roll 302 and pressure roll 330.

Figure 5:
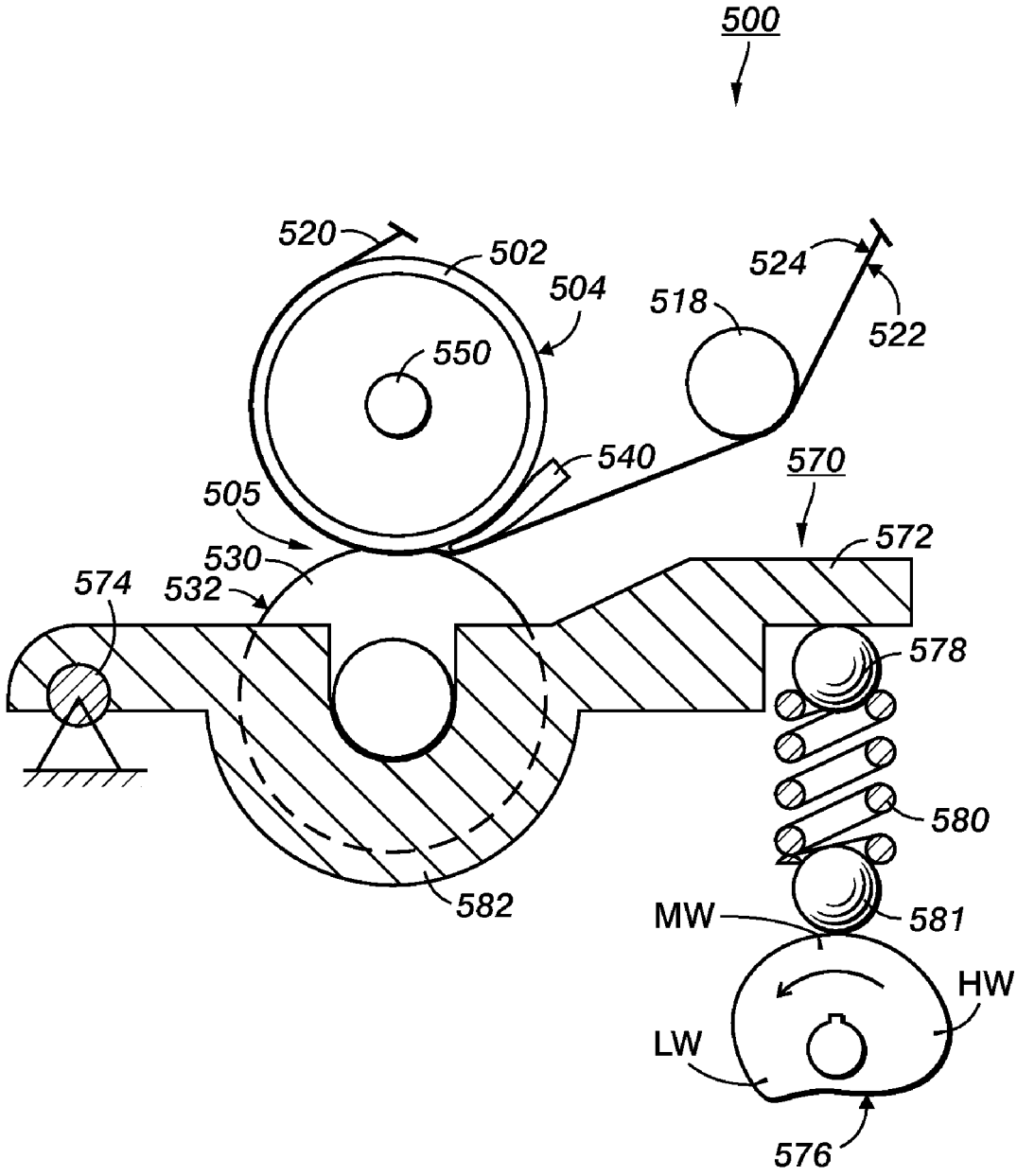
FIG. 5 illustrates an exemplary embodiment of a fuser including a mechanism for moving a pressure roll relative to a fuser belt.

In embodiments, the fuser 300 is constructed to allow the pressure roll 330 to be moved relative to the fuser belt 320 and fuser roll 304 in an adjustable manner to vary the nip load to control the nip width for different media types and image contents. FIG. 5 depicts an exemplary embodiment of a fuser 500 including a mechanism 570 for moving the pressure roll 530 into contact with the fuser belt 520 supported on the fuser roll 502 in a fuser 500. The fuser roll 502, pressure roll 530 and fuser belt 520 can have the same configurations as the fuser roll 302, pressure roll 330 and fuser belt 320, respectively, shown in FIGS. 3 and 4. The fuser 500 can also include one or more idler rolls (not shown), such as the idler roll 306, 310, 314 and 318 of the fuser 300, to support the fuser belt 500. FIG. 5 shows the outer surface 532 of pressure roll 530 positioned in contact with the outer surface 522 of fuser belt 520. The mechanism 570 includes a load arm 572 having a surface 582 configured to support the pressure roll 530. The mechanism 570 further includes a pivot 574, such as a ball or roller, about which the load arm 572 can be pivoted either counter-clockwise to move the pressure roll 530 toward the fuser belt 520 to increase the width of nip 505, or clockwise to move the pressure roll 530 away from the fuser belt 520 to decrease the width of nip 505. The mechanism 570 includes a rotatable cam 576. The cam 576 can be mounted on a rotatable shaft, for example. At least one compression spring 580 is positioned between rollers 578, 581. The spring 580 acts to resiliently bias the load arm 572 via the roller 578, and resiliently bias the cam 576 via the roller 581.

The load arm 572 is caused to pivot about the pivot 574 by rotating the cam 576. As shown, the cam 576 is rotated counter-clockwise to cause the load arm 572 to pivot either clockwise or counter-clockwise depending on the location of the outer surface of the cam 576 that contacts the roller 581. The outer surface of the cam 576 is shaped to include at least three contact points "LW", "MW" and "HW." When the roller 581 is in contact with the contact point "LW," the spring 580 resiliently urges the roller 578 against the load arm 572 to produce the desired width of nip 505 for fusing toner on light-weight media. Rotation of the cam 576 to move the contact point "MW" in contact with the roller 578 causes the load arm 572 to rotate counter-clockwise, causing the roller 530 to apply a larger load against the fuser belt 520 and fuser roll 502 and increase the width of nip 505 to that desired for fusing toner on medium-weight media. Rotation of the cam 576 to bring the contact point "HW" in contact with the roller 578 causes the load arm 572 to rotate further counter-clockwise, causing the roller 530 to apply a larger load against the fuser belt 520 and fuser roll 502 and increase the width of nip 505 to that desired for fusing toner on heavy-weight media. In embodiments, multiple additional intermediate settings can also be provided by the mechanism 570 for fusing toner on intermediate-thickness media.

In embodiments, the mechanism 570 can be connected to a controller, such as controller 370, to enable the cam 576 to be rapidly activated to provide rapid macro-nip width adjustability of nip 505. In embodiments, the mechanism 570 can be actuated in less than about 5 seconds, for example. The mechanism 570 allows the width of nip 505 to be adjusted as a function of media properties and/or image content without degrading the stripping function in the fuser 500.

In the fuser 300, the one or more outer elastomeric layers of the fuser belt 320 are sufficiently thin, and the outer surface 332 of the pressure roll 330 is sufficiently soft, that the elastomeric layer(s) experience only minimal strain (creep) when the outer surface 332 applies a force to the fuser belt 320. These features are effective to minimize relative motion between media and the outer surface 322 of the fuser belt 320. By using a thin fuser belt 320, the fuser 300 does not rely on creep of a fusing member to strip media from the fuser belt 320.

Figure 6A:
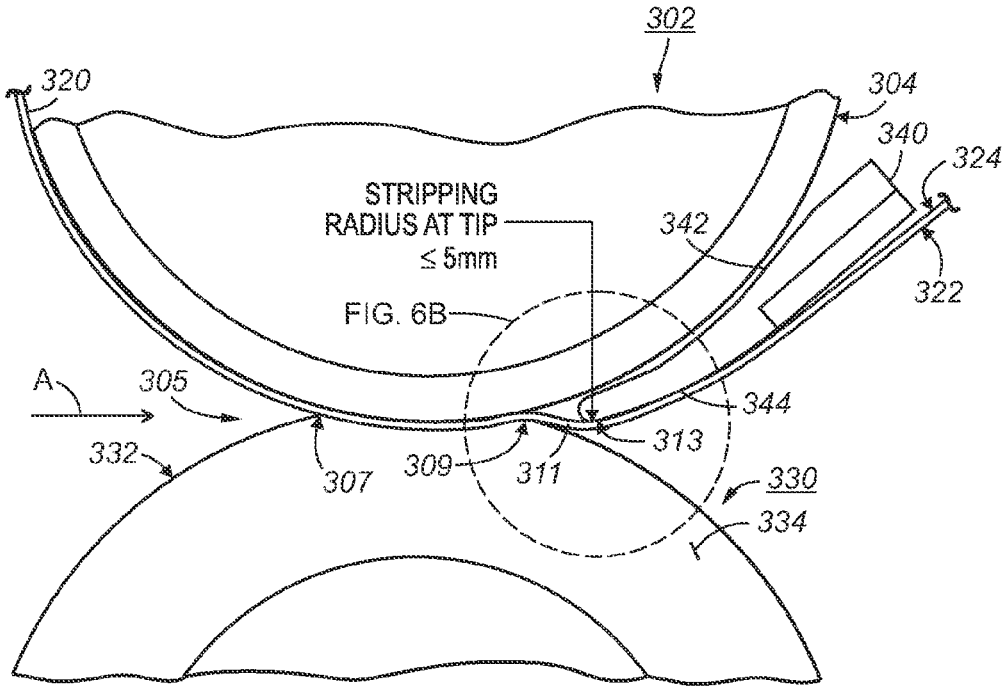
FIG. 6A is an enlarged view of a portion of the fuser of FIG. 3 including the media stripping member and FIG. 6B is an enlarged view of FIG. 6A.
Figure 6B:
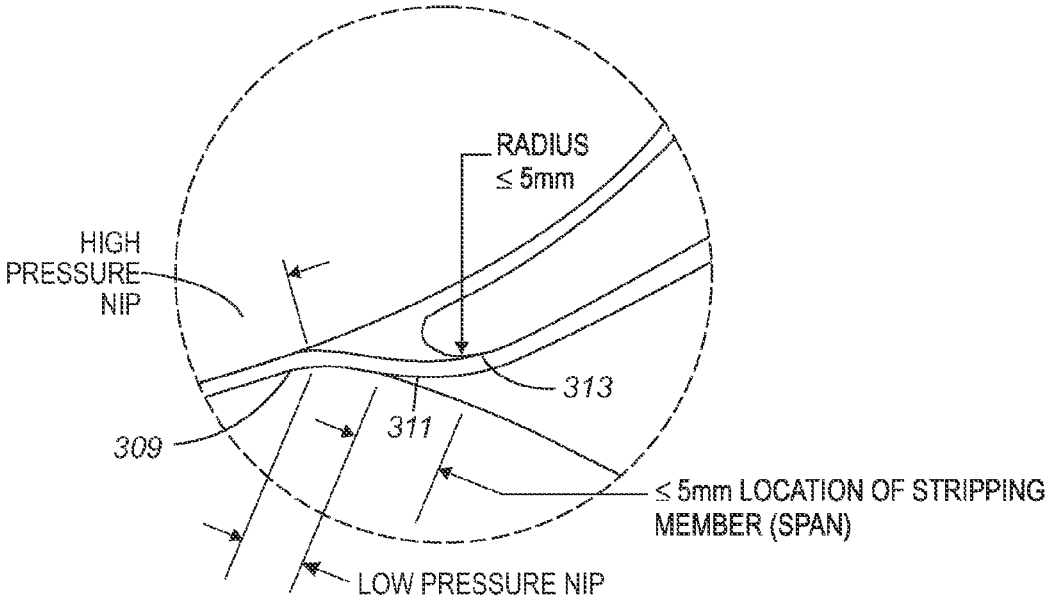

As shown in FIGS. 3 and 4, in the fuser 300, the stripping function is provided by using a stripping member 340 located internally to the fuser belt 320. FIGS. 6A and 6B show a portion of the fuser 300 including the fuser roll 302, pressure roll 330, fuser belt 320 located between the outer surface 304 of the fuser roll 302 and the outer surface 332 of the pressure roll 330, and the stripping member 340. The nip 305 extends in the process direction A between an inlet end 307 and an opposite outlet end 309. Media are fed to the inlet end 307 and exit the nip 305 at the outlet end 309. The stripping member 340 includes a surface 342 facing the outer surface 304 of the fuser roll 302, and an opposite surface 344 contacting the inner surface 324 of the fuser belt 320. The fuser belt 320 separates from the fuser roll 302 at the outlet end 309 of the nip 305. In embodiments, the stripping member 340 is located relative to the outlet end 309 of nip 305 to allow stripping to occur immediately after media exit from the nip 305. In embodiments, one end of the stripping member 340 can be spaced about 5 mm from the outlet end 309 of the nip 305. The fuser 500 shown in FIG. 5 includes a stripping member 540 located proximate to the outlet end of nip 505. The stripping member 540 can have the same configuration as the stripping member 340.

The fuser belt 320 forms a stripping radius 313 proximate to the outlet end 309 of the nip 305, e.g., within about 5 mm of outlet end 309. The stripping radius 313 can be about 5 mm or less, for example. The size of the stripping radius 313 is independent of the width of nip 305. The portion of the fuser belt 320 extending between the outlet end 309 and the stripping radius 313 forms a secondary nip 311 between the outer surface 322 of fuser belt 320 and the outer surface 332 of pressure roll 330. In embodiments, the secondary nip 311 provides a stripping function. Some fusing can also occur at the secondary nip 311. The stripping member 340 is adapted to mechanically separate (i.e., strip) media and toner carried on the media from the outer surface 322 of the fuser belt 320 at stripping radius 313.

The nip 305 (or primary nip) located between the fuser roll 302 and pressure roll 330 with the fuser belt 320 disposed between these rolls is a higher-pressure zone (analogous to a nip formed between a fuser roll and pressure roll) as compared to the secondary nip 311 immediately following the nip 305. The incorporation of the stripping member 340 in the fuser 300 allows the width of nip 305 to be set to a small width (with a corresponding low nip pressure) for thin media and/or media carrying a low toner mass, to a large width (with a corresponding high nip pressure) for thick media and/or media carrying a high toner mass, and to multiple intermediate widths for intermediate-thickness media and/or media carrying an intermediate toner mass. The combination of a thin fuser belt 320 (which does not rely on creep for media stripping) and the stripping member 340 allows the fusing and stripping functions to be de-coupled from each other (i.e., are separately controllable substantially independent of the other) for all weights of media that may be used in embodiments of the fuser 300. The use of the mechanism for moving the pressure roll 330 relative to the fuser belt 320 allows the width of nip 305 to be adjusted for different weights of media.

In embodiments of the fusers, such as fusers 300 and 500, the characteristics of toner images carried on media can be used to determine optimum fuser settings. For example, it is desirable to use more fusing (i.e., a higher temperature, pressure and/or dwell) for toner images that have large media area coverage, and to use much less fusing (i.e., a lower temperature, pressure and/or dwell) for text documents. Over-fusing (i.e., use of excessive temperature, pressure and/or dwell) is typically associated with premature fuser belt failure. When a thin sheet of media is properly heated, it will retain a higher percentage of its beam strength upon exiting from the nip. Another benefit of using a smaller nip for light-weight media is that a lower pressure roll temperature can then be used, which can reduce the occurrence of backside image artifacts.

In embodiments of the fusers, such as fusers 300 and 500, thick media can also benefit from substantially eliminating fusing surface creep and wrinkle for operating conditions ranging from a small/low pressure nip to a large/high pressure nip used in the fusers. Consequently, fuser belt life can be extended in embodiments of the fusers.

In embodiments, the primary nip width of the fusers, such as fusers 300 and 500, can be increased (which increases dwell), while the temperature set point to which the fuser belt is heated can be decreased, to fuse toner on thick media and/or media with a high toner mass. In such embodiments, the fuser belt can supply a sufficient amount of thermal energy to the media during contact with the fuser belt, with the increased dwell and decreased temperature, to fuse toner on such media. In other embodiments, the primary nip width of the fusers can be decreased (which decreases dwell), and the temperature set point to which the fuser belt is heated can be increased, to fuse toner on thick media and/or media with a high toner mass. In such embodiments, the fuser belt can also supply a sufficient amount of thermal energy to the media, using the decreased dwell and increased temperature, to fuse toner on such media.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser for fusing toner on a medium, comprising:

a pressure roll;

a fuser belt;

a first nip formed by the fuser belt contacting the pressure roll, the first nip including an inlet end where the medium enters the first nip, an outlet end where the medium exits the first nip, and a nip width defined between the inlet end and the outlet end, wherein the nip width is adjusted based on at least one of a weight of the medium and a mass of a toner;

a mechanism for moving the pressure roll toward or away from the fuser belt to adjust the nip width; and a stripping member for stripping the medium from the fuser belt after the medium exits from the outlet end of the first nip;

wherein the fuser belt includes an inner surface contacting a fuser roll, and the fuser belt separates from the fuser roll at the outlet end of the first nip, the stripping member is located between the fuser roll and the inner surface of the fuser belt, and the stripping member includes an end spaced from the outlet end at which the fuser belt forms a stripping radius, and a second nip is formed between an outer surface of the fuser belt and a surface of the pressure roll between the outlet end and the stripping radius, and wherein the end of the stripping member is located about 5 mm or less from the outlet end of the first nip, and the stripping radius is about 5 mm or less.

2. The fuser of claim 1, wherein:

the fuser belt has a thickness of about 0.1 mm to about 0.6 mm; and the mechanism for moving the pressure roll is adapted to adjust the nip width to about 5 mm to about 20 mm.

3. The fuser of claim 1, wherein:

the fuser belt includes an outer layer comprised of an elastomeric material; and the pressure roll includes an outer layer comprised of an elastomeric material which contacts the outer layer of the fuser belt at the first nip.

4. The fuser of claim 1, wherein the mechanism for moving the pressure roll comprises:

a load arm supporting the pressure roll, the load arm being rotatable in clockwise and counter-clockwise directions;

a cam; and at least one spring positioned to resiliently bias the load arm and the cam;

wherein the cam is rotatable to cause the load arm to rotate counter-clockwise which moves the pressure roll toward the fuser belt to increase the nip width, or to cause the load arm to rotate clockwise which moves the pressure roll away from the fuser belt to decrease the nip width.

5. The fuser of claim 4, wherein the cam includes multiple settings which correspond to different respective positions of the pressure roll relative to the fuser belt.

6. The fuser of claim 1, further comprising:

a plurality of idler rolls supporting the fuser belt; and at least one heating element located inside of each of a fuser roll and at least one of the idler rolls.

7. A printing apparatus comprising a fuser according to claim 6.

8. A fuser for fusing toner on a medium, comprising:

a fuser roll;

a pressure roll including an outer layer comprised of an elastomeric material;

a fuser belt supported on the fuser roll and including an outer layer comprised of an elastomeric material;

a first nip formed by the outer layer of the fuser belt contacting the outer layer of the pressure roll, the first nip including an inlet end where the medium enters the first nip, an outlet end where the medium exits the first nip, and a nip width defined between the inlet end and the outlet end, wherein the nip width is adjusted based on at least one of a weight of the medium and a mass of a toner;

a mechanism for moving the pressure roll toward or away from the fuser belt to vary the magnitude of a load applied by the pressure roll to the fuser belt to adjust the nip width; and a stripping member located between the fuser roll and fuser belt for stripping the medium from the fuser belt after the medium exits from the outlet end of the first nip;

wherein the medium is stripped from the fuser belt substantially without creep of the fuser belt, and wherein the fuser belt separates from the fuser roll at the outlet end of the first nip, the stripping member includes an end spaced from the outlet end at which the fuser belt forms a stripping radius which is about 5 mm or less, a second nip is formed between the outer layer of the fuser belt and the outer layer of the pressure roll between the outlet end and the stripping radius, and the end of the stripping member is located about 5 mm or less from the outlet end of the first nip.

9. The fuser of claim 8, wherein:

the fuser belt has a thickness of about 0.1 mm to about 0.6 mm; and the mechanism for moving the pressure roll is adapted to adjust the nip width to about 5 mm to about 20 mm.

10. The fuser of claim 8, wherein the mechanism for moving the pressure roll comprises:

a load arm supporting the pressure roll, the load arm being rotatable in clockwise and counter-clockwise directions;

a cam; and at least one spring positioned to resiliently bias the load arm and the cam;

wherein the cam is rotatable to cause the load arm to rotate counter-clockwise and move the pressure roll toward the fuser belt to increase the nip width, or to cause the load arm to rotate clockwise and move the pressure roll away from the fuser belt to decrease the nip width.

11. The fuser of claim 8, further comprising:

a plurality of idler rolls supporting the fuser belt; and at least one heating element located inside of each of the fuser roll and at least one of the idler rolls.

12. A printing apparatus comprising a fuser according to claim 11.

13. A method of fusing toner on a medium in a fuser comprising a fuser roll, a pressure roll and a fuser belt located between the fuser roll and the pressure roll, the method comprising:

moving the pressure roll toward or away from the fuser belt to adjust a nip width of a first nip formed by the fuser belt contacting the pressure roll to a first nip width defined between an inlet end and an outlet end of the nip, wherein the first nip width is adjusted based on at least one of a weight of a first medium and a mass of a first toner;

feeding the first medium carrying first toner to the inlet end of the nip;

heating and applying pressure to the first medium at the nip to fuse the first toner onto the first medium; and stripping the first medium from the fuser belt after the first medium exits from the outlet end of the nip, wherein the fuser belt separates from the fuser roll at the outlet end of the first nip, the first medium is stripped from the fuser belt by a stripping member located between the fuser roll and the fuser belt, the stripping member includes an end spaced from the outlet end at which the fuser belt forms a stripping radius, and a second nip is formed between the fuser belt and pressure roll between the outlet end and the stripping radius, and wherein the end of the stripping member is located about 5 mm or less from the outlet end of the first nip, and the stripping radius is about 5 mm or less.

14. The method of claim 13, further comprising:

moving the pressure roll toward or away from the fuser belt to adjust the width of the first nip between the inlet end and the outlet end from the first nip width to a second nip width larger than the first nip width;

feeding a second medium carrying second toner to the inlet end of the first nip, wherein the second medium is thicker than the first medium and/or the second toner has a higher mass than the first toner, and the nip width is adjusted to the second nip width based on at least one of the weight of the second medium and the mass of the second toner;

heating and applying pressure to the second medium at the first nip to fuse the second toner onto the second medium; and stripping the second medium from the fuser belt after the second medium exits from the outlet end of the first nip.

15. The method of claim 14, wherein:

the fuser belt includes an outer layer comprised of an elastomeric material;

the pressure roll includes an outer layer comprised of an elastomeric material which contacts the outer layer of the fuser belt at the first nip; and the first medium and the second medium are stripped from the outer layer of the fuser belt substantially without creep of an outer surface of the fuser belt.

* * * * *